US010490919B2

(12) United States Patent
Herring

(10) Patent No.: US 10,490,919 B2
(45) Date of Patent: Nov. 26, 2019

(54) DUAL CONNECTOR SYSTEM

(71) Applicant: TE CONNECTIVITY CORPORATION, Berwyn, PA (US)

(72) Inventor: Michael David Herring, Apex, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 119 days.

(21) Appl. No.: 15/458,099

(22) Filed: Mar. 14, 2017

(65) Prior Publication Data

US 2018/0270955 A1 Sep. 20, 2018

(51) Int. Cl.
*H01R 12/71* (2011.01)

(52) U.S. Cl.
CPC ..... *H01R 12/716* (2013.01)

(58) Field of Classification Search
CPC .... H05K 1/181; H05K 1/0203; H01R 12/271; H01R 33/74
See application file for complete search history.

(56) References Cited

U.S. PATENT DOCUMENTS 3,479,634 A 11/1969 Pritulsky
4,678,252 A * 7/1987 Moore ..... H01R 12/83 439/326
5,242,312 A 9/1993 Tondreault
5,260,854 A 11/1993 Hileman et al.
5,324,204 A 6/1994 Lwee
5,643,001 A 7/1997 Kaufman et al.
6,394,817 B1 5/2002 Kihira et al.
7,018,222 B2 3/2006 Chang
7,074,090 B2 7/2006 Ho et al.
7,101,222 B2 9/2006 Ho et al.
7,300,298 B2 11/2007 Kameda
7,344,402 B2 3/2008 Langgood et al.
7,467,963 B2 12/2008 Chen
7,470,136 B2 * 12/2008 Yahiro ..... H01R 13/6275 439/326
7,510,414 B2 3/2009 Yu et al.
7,909,644 B1 3/2011 Li et al.
(Continued)

OTHER PUBLICATIONS

Tyco Electronic, Product Specification, DDR S.O.DIMM Socket 200 Positions, Jul. 11, 2007, 5 pages.
(Continued)

*Primary Examiner* — James Wu
*Assistant Examiner* — Hung Q Dang

(57) ABSTRACT

A dual connector system includes a host circuit board having a first electrical connector at a front mounting area, a second electrical connector at an intermediate mounting area, and a support anchor at a rear mounting area. The dual connector system includes a dual connector module having a module circuit board having a communication component on an upper surface, front contact pads proximate to a front edge for electrically connecting to the first electrical connector and intermediate contact pads remote from the front and rear edges for electrically connecting to the second electrical connector. The dual connector module has a rear support extending below the module circuit board proximate to a rear edge for interfacing with the support anchor to support the rear edge of the module circuit board relative to the host circuit board.

20 Claims, 5 Drawing Sheets

(56) References Cited

U.S. PATENT DOCUMENTS

| | | | | |
|---|---|---|---|---|
| 7,987,584 | B2 | 8/2011 | Barna et al. | |
| 8,113,883 | B2 | 2/2012 | Chen et al. | |
| 8,544,831 | B2 | 10/2013 | Klein et al. | |
| 8,588,561 | B2 | 11/2013 | Zbinden et al. | |
| 8,764,457 | B2 | 7/2014 | Chen et al. | |
| 8,787,711 | B2 * | 7/2014 | Zbinden | G02B 6/4232 385/14 |
| 9,166,315 | B1 | 10/2015 | Phillips et al. | |
| 9,871,325 | B2 | 1/2018 | Patel et al. | |
| 9,972,927 | B2 | 5/2018 | Nichols et al. | |
| 9,991,615 | B1 * | 6/2018 | Herring | H01R 12/7005 |
| 2007/0099470 | A1 | 5/2007 | Yang | |
| 2010/0165592 | A1 | 7/2010 | Takao | |
| 2012/0327576 | A1 | 12/2012 | Xiao et al. | |
| 2014/0094063 | A1 | 4/2014 | Daly | |
| 2014/0111931 | A1 | 4/2014 | Casserly et al. | |
| 2014/0179167 | A1 | 6/2014 | Long et al. | |
| 2015/0318633 | A1 | 11/2015 | Herring et al. | |
| 2016/0134040 | A1 | 5/2016 | Phillips et al. | |
| 2018/0076587 | A1 | 3/2018 | Herring et al. | |
| 2018/0309213 | A1 | 10/2018 | Harmon et al. | |

OTHER PUBLICATIONS

TE Connectivity Emboss Assembly DDR1 & DDR2 SODIMM Socket 200P Standard Profile Standard Type, Drawing No. C-1565917, Dec. 2001, 1 page.
U.S. Appl. No. 15/490,252, filed Apr. 18, 2017.
U.S. Appl. No. 15/492,070, filed Apr. 20, 2017.
U.S. Appl. No. 15/723,287, filed Oct. 3, 2017.
Co-Pending U.S. Appl. No. 15/723,287, filed Oct. 3, 2017.

* cited by examiner

DUAL CONNECTOR SYSTEM

BACKGROUND OF THE INVENTION

The subject matter herein relates generally to a dual connector system.

Dual connector systems include first and second electrical connectors mounted to a host circuit board that are electrically connected to a dual connector module. The dual connector module includes a module circuit board having connector interfaces for interfacing with the first and second electrical connectors. Typically communication components are mounted to the module circuit board. For example, electrical and/or optical components may be mounted to the module circuit board. In various applications an on-board optics module may be mounted to the module circuit board. Heat dissipation of the communication components may be provided, such as in the form of a heat sink thermally coupled to the communication components and supported by the module circuit board. Mating of the dual connector module to the first and second electrical connectors typically involves loading the dual connector module into a first position in a vertical direction and then sliding the dual connector module to a second position in a horizontal direction to mate with the first and second electrical connectors.

However, some dual connector modules are bulky and heavy. Conventional dual connector systems provide the first and second electrical connectors in fixed locations relative to each other. However, various size dual connector modules may be designed to be interface compatible with the electrical connectors. For example, the dual connector modules may have different lengths to provide a larger surface area on the module circuit board for mounting a greater number of communication components or larger communication components. The differently sized dual communication modules have different centers of mass. Some dual connector modules may have a center of mass shifted to far to one side of the electrical connectors, which define the anchor points for mechanical retention of the dual connector module, which may cause difficulties in mating the dual connector module to the electrical connectors and/or may cause damage to the electrical connectors. For example, the force and moment loads applied to the electrical connectors may cause damage during assembly or during use, such as from vibration of the system.

A need remains for a dual connector system that uses multiple size dual connector modules that are interface compatible and not susceptible to damage.

BRIEF DESCRIPTION OF THE INVENTION

In one embodiment, a dual connector system is provided including a host circuit board having a first electrical connector at a front mounting area of the host circuit board, a second electrical connector at an intermediate mounting area of the host circuit board, and a support anchor at a rear mounting area of the host circuit board. The intermediate mounting area is positioned between the front mounting area and the rear mounting area generally along a longitudinal axis. The dual connector system includes a dual connector module having a module circuit board including an upper surface and a lower surface and extending between a front edge and a rear edge. The lower surface faces the host circuit board. The module circuit board has at least one communication component on the upper surface. The module circuit board has front contact pads proximate to the front edge for electrically connecting to the first electrical connector and intermediate contact pads remote from the front edge and remote from the rear edge for electrically connecting to the second electrical connector. The dual connector module has a rear support extending below the lower surface of the module circuit board proximate to the rear edge for interfacing with the support anchor to support the rear edge of the module circuit board relative to the host circuit board.

In another embodiment, a dual connector module is provided including a module circuit board including an upper surface and a lower surface, a front edge and a rear edge, and a first side edge and a second side edge. The module circuit board has front contact pads proximate to the front edge along at least one of the upper surface and the lower surface defining a first connector interface configured for electrically connecting to a first electrical connector. The module circuit board has intermediate contact pads on the lower surface remote from the front edge and remote from the rear edge defining a second connector interface configured for electrically connecting to a second electrical connector. The dual connector module includes a communication component on the upper surface electrically connected to at least one of the first connector interface and the second connector interface. The dual connector module includes a rear support extending below the lower surface of the module circuit board proximate to the rear edge. The rear support has a support surface a distance below the lower surface for interfacing with a support anchor on the host circuit board to support the rear edge of the module circuit board relative to the host circuit board such that the host circuit board is held parallel to and spaced apart from the host circuit board.

In a further embodiment, a dual connector system is provided including a host circuit board having a first electrical connector at a front mounting area of the host circuit board, a second electrical connector at an intermediate mounting area of the host circuit board, and a support anchor at a rear mounting area of the host circuit board. The intermediate mounting area is positioned between the front mounting area and the rear mounting area generally along a longitudinal axis. The first electrical connector has a card slot and first contacts and the second electrical connector has an upper mating surface and second contacts at the upper mating surface. The support anchor has a base and a loop extending from a top of the base defining a cavity between the loop and the top of the base. The dual connector system includes a dual connector module having a module circuit board including an upper surface and a lower surface and extending between a front edge and a rear edge. The lower surface faces the host circuit board. The module circuit board has at least one communication component on the upper surface. The module circuit board has front contact pads proximate to the front edge defining a first connector interface for electrically connecting to the first electrical connector and intermediate contact pads on the lower surface remote from the front edge and remote from the rear edge defining a second connector interface for electrically connecting to the second electrical connector. The dual connector module has a rear support extending below the lower surface of the module circuit board proximate to the rear edge for interfacing with the support anchor to support the rear edge of the module circuit board relative to the host circuit board. The rear support has a support surface spaced apart a distance from the lower surface of the module circuit board. The dual connector module is coupled to the host circuit board by lowering the dual connector module in a loading direction generally perpendicular to the host circuit board to a pre-stage position where the first connector interface is adjacent to the first electrical connector, the second connector interface is adjacent to the second electrical connector and the support surface of the rear support rests on the top of the base of the support anchor. The dual connector module is slid forward from the pre-stage position to a mated position in the mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads. The rear support is slid forward along the top of the base of the support anchor and received in the cavity to secure the rear support to the support anchor.

DETAILED DESCRIPTION OF THE INVENTION

Figure 1:
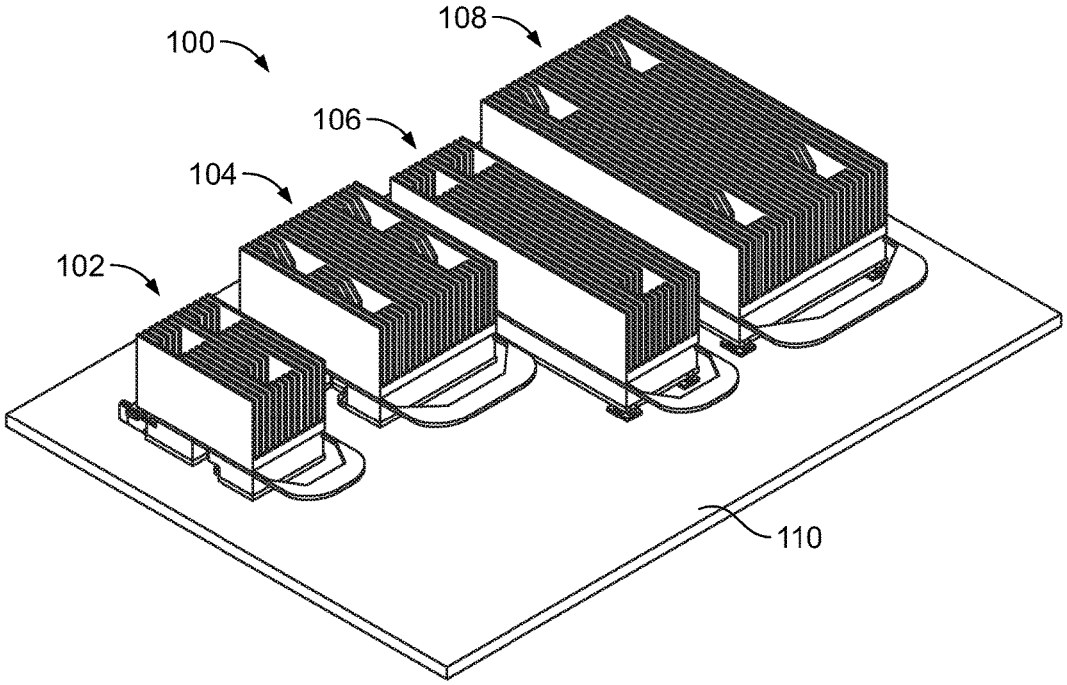
FIG. 1 is a perspective view of a dual connector system formed in accordance with an exemplary embodiment showing dual connector modules mounted to a host circuit board.

FIG. 1 is a perspective view of a dual connector system 100 formed in accordance with an exemplary embodiment showing dual connector modules 102, 104, 106, 108 mounted to a host circuit board 110. While four dual connector modules 102, 104, 106, 108 are illustrated in FIG. 1, any number of any of the dual connector modules 102, 104, 106, 108 may be provided in various embodiments. The dual connector modules 102, 104, 106, 108 have different sizes; however, various dual connector modules 102, 104, 106, 108 are interface compatible to the host circuit board 110.

In the illustrated embodiment, the dual connector module 102 is a short and narrow dual connector module; the dual connector module 104 is a short and wide dual connector module; the dual connector module 106 is a long and narrow dual connector module; and the dual connector module 108 is a long and wide dual connector module. In an exemplary embodiment, the narrow dual connector modules 102, 106 are interface compatible such that either of the narrow dual connector modules 102, 106 may be mounted to the host circuit board 110 at the corresponding mounting locations, while the wide dual connector modules 104, 108 are interface compatible such that either of the wide dual connector modules 104, 108 may be mounted to the host circuit board 110 at the corresponding mounting locations. In an exemplary embodiment, the long dual connector modules 106, 108 have additional support at the rear ends thereof to help with mating and add stability in use.

Figure 2:
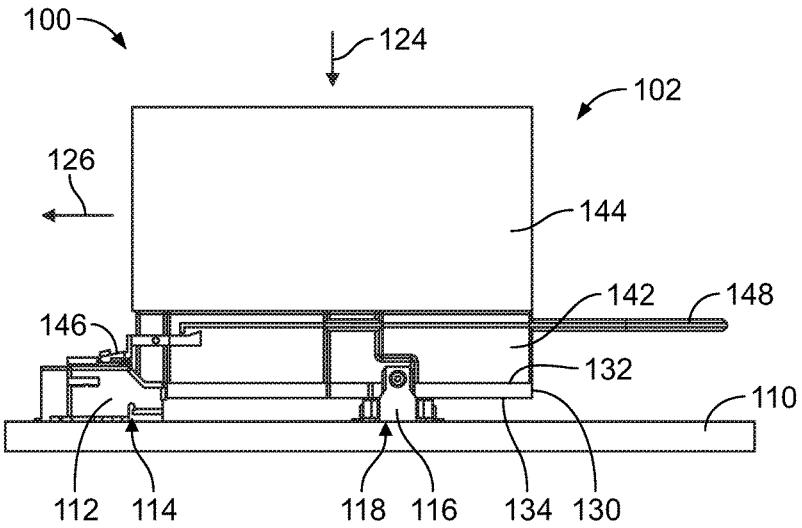
FIG. 2 is a side view of the dual connector system showing a dual connector module in accordance with an exemplary embodiment.
Figure 3:
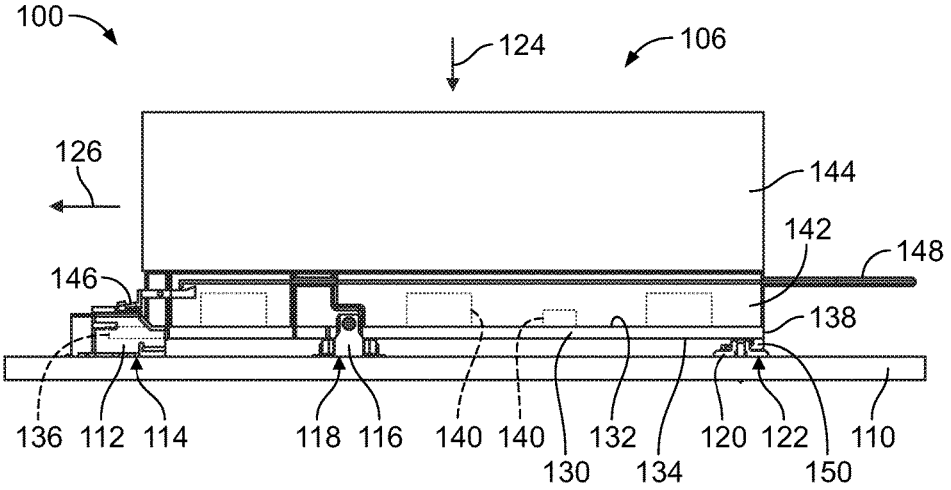
FIG. 3 is a side view of the dual connector system showing a dual connector module in accordance with an exemplary embodiment.

FIG. 2 is a side view of the dual connector system 100 showing the short dual connector module 102 in accordance with an exemplary embodiment. FIG. 3 is a side view of the dual connector system 100 showing the long dual connector module 106 in accordance with an exemplary embodiment. Optionally, the long dual connector module 106 may be approximately twice as long as the short dual connector module 102; however other lengths are possible in alternative embodiments. In an exemplary embodiment, the dual connector modules 102, 106 are interface compatible and thus interchangeable when mounted to the host circuit board 110. For example, mating interfaces of the dual connector modules 102, 106 are identical for interfacing with various electrical connectors on the host circuit board 110.

The host circuit board 110 has a first electrical connector 112 at a front mounting area 114 of the host circuit board 110 and a second electrical connector 116 at an intermediate mounting area 118 of the host circuit board 110. In applications using the long dual connector module 106, one or more support anchors 120 are provided at a rear mounting area 122 of the host circuit board 110 for supporting a rear portion of the long dual connector module 106. In applications using the short dual connector module 102, the support anchors 120 may be removed from the host circuit board 110, such as to allow mounting of other components to the host circuit board 110 at the rear mounting area. Alternatively, the support anchors 120 may still be provided in the rear mounting area 122 and just not used to support the short dual connector module 102 because the short dual connector module 102 does not extend far enough to interface with the support anchors 120.

When the dual connector modules 102, 106 are mounted to the host circuit board 110, the dual connector modules 102, 106 interface with both electrical connectors 112, 116. Optionally, the dual connector module 102 or 106 may be simultaneously mated with the first and second electrical connectors 112, 116 during a mating process. In an exemplary embodiment, the first electrical connector 112 is a different type of electrical connector than the second electrical connector 116. For example, the first electrical connector 112 may be a front loaded electrical connector, such as a card edge connector. The second electrical connector 116 may be a top loaded electrical connector, such as a mezzanine connector. The electrical connectors 112, 116 may be used for different types of signaling. For example, the first electrical connector 112 may be used for high-speed signaling while the second electrical connector 116 may be used for low speed signaling, powering, or for another type of connection.

In an exemplary embodiment, mating of the dual connector module 102 or 106 to the host circuit board 110 occurs by loading the dual connector module 102 or 106 in a loading direction 124 (for example, downward) to a pre-staged position and then mating the dual connector module 102 or 106 in a mating direction 126 (for example, forward) to a mated position. The loading direction 124 may be perpendicular to the host circuit board 110, such as in a vertical direction, and the mating direction 126 may be parallel to the host circuit board 110, such as in a horizontal direction.

The dual connector modules 102, 106 are similar to each other; however, the dual connector module 106 is longer than the dual connector module 102. Like components of the dual connector modules 102, 106 may be identified with like reference numerals. While the description below relates to the dual connector module 106, the dual connector module 102 may have similar components and features.

The dual connector module 106 includes a module circuit board 130 having an upper surface 132 and a lower surface 134. The module circuit board 130 extends between a front edge 136 (shown in phantom) and a rear edge 138. The lower surface 134 faces the host circuit board 110 and may be parallel to and spaced apart from the host circuit board 110 when mated to the electrical connectors 112, 116.

In an exemplary embodiment, the dual connector module 106 includes one or more communication components 140 on the upper surface 132 and/or the lower surface 134. The communication components 140 may be electrical components, optical components, or other types of components. In an exemplary embodiment, one or more of the communication components 140 may be on-board optical modules. The communication components 140 may include optical/digital converters for converting between optical and electrical signals. Other types of communication components 140 may be provided on the module circuit board 130, such as processors, memory modules, antennas, or other types of components.

In an exemplary embodiment, the dual connector module 106 includes a housing or shell 142 on the upper surface 132. The shell 142 encloses the communication components 140. In an exemplary embodiment, the shell 142 extends generally around the perimeter of the module circuit board 130; however, portions of the module circuit board 130 may be exposed exterior of the shell 142. In an exemplary embodiment, the dual connector module 106 includes a heat sink 144 thermally coupled to one or more of the communication components 140. The heat sink 144 dissipates heat from the communication components 140. The heat sink 144 may be mounted to the shell 142 and/or the module circuit board 130. In an exemplary embodiment, the heat sink 144 extends substantially the entire length of the dual connector module 106. The heat sink may have a plurality of fins having a large surface area for dissipating heat.

In an exemplary embodiment, the dual connector module 106 includes a latch 146 at a front end of the dual connector module 106 for latchably securing the dual connector module 106 to the first electrical connector 112. A tether 148 is coupled to the latch 148 and extends to the rear end of the dual connector module 106 for releasing the latch 146.

In an exemplary embodiment, the dual connector module 106 includes one or more rear supports 150 extending below the lower surface 134 of the module circuit board 130 proximate to the rear edge 138 for interfacing with the corresponding support anchors 120. The rear supports 150 support the rear edge 138 of the module circuit board 130 relative to the host circuit board 110. The rear supports 150 may be used to keep the module circuit board 130 generally parallel to the host circuit board 110 during mating of the dual connector module 106 to the electrical connectors 112, 116. The rear supports 150 are used to align the front edge 136 of the module circuit board 130 with the first electrical connector 112 during mating. For example, the second electrical connector 116 may act as a fulcrum and the rear supports 150 may stabilize the rear edge 138 at a predetermined vertical position to locate the front edge 136 at a predetermined vertical position for mating with the first electrical connector 112. The rear supports 150 may be used to stabilize the dual connector module 106 in use, such as to prevent damage to the electrical connectors 112, 116, such as from vibration.

Figure 4:
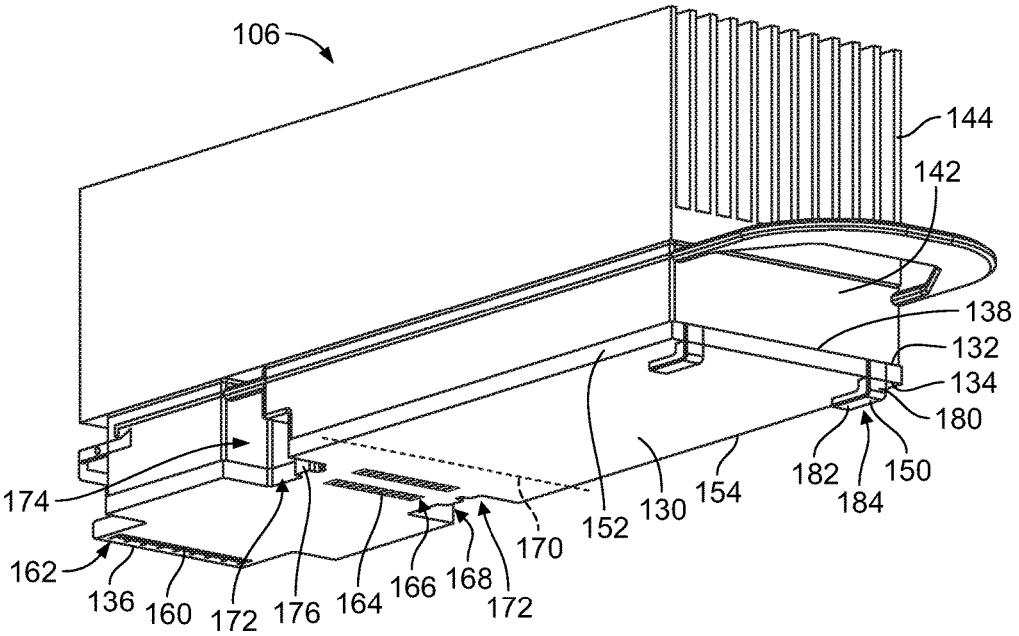
FIG. 4 is a bottom perspective view of the dual connector module 106 in accordance with an exemplary embodiment.

FIG. 4 is a bottom perspective view of the dual connector module 106 in accordance with an exemplary embodiment. FIG. 4 shows the shell 142 above the module circuit board 130 and the heat sink 144 above the shell 142. Optionally, the shell 142 and the heat sink 144 may be a unitary structure. The rear supports 150 are provided at the rear edge 138. Optionally, the rear supports 150 may be integral with the shell 142. Alternatively, the rear supports 150 may be separate and discrete components coupled to the module circuit board 130 and/or the shell 142. In the illustrated embodiment, the rear supports 150 are provided near first and second side edges 152, 154 of the module circuit board 130; however, the rear supports 150 may be in other locations in alternative embodiments.

In an exemplary embodiment, the module circuit board 130 includes front contact pads 160 proximate to the front edge 136 along the lower surface 134 and/or the upper surface 132. With additional reference to FIG. 5, which is a top view of the module circuit board 130 relative to the first and second electrical connectors 112, 116, the front contact pads 160 are shown on the upper surface 132 in FIG. 5. The front contact pads 160 are shown on the lower surface 134 in FIG. 4. The front contact pads 160 define a first connector interface 162 configured for electrically connecting to the first electrical connector 112 (shown in FIG. 3). For example, the first connector interface 162 may be a card edge interface at the front edge 136 configured to be plugged into a card slot of the first electrical connector 112. The front contact pads 160 are circuits of the module circuit board 130. The front contact pads 160 may be electrically connected to corresponding communication components 140 via traces on various layers of the module circuit board 130. In an exemplary embodiment, the front contact pads 160 convey high speed data signals. Optionally, various front contact pads 160 may be arranged in pairs configured to carry differential signals.

The module circuit board 130 includes intermediate contact pads 164 (FIG. 4) on the lower surface 134 that define a second connector interface 166 configured for electrically connecting to the second electrical connector 116 (shown in FIG. 3). The intermediate contact pads 164 may be electrically connected to corresponding communication components 140 via traces on various layers of the module circuit board 130. Optionally, at least some of the intermediate contact pads 164 may be power pads configured to transmit power between the second electrical connector 116 and the module circuit board 130 for powering the communication components 140. Optionally, the intermediate contact pads 164 may be provided in multiple rows along the lower surface 134.

Figure 5:
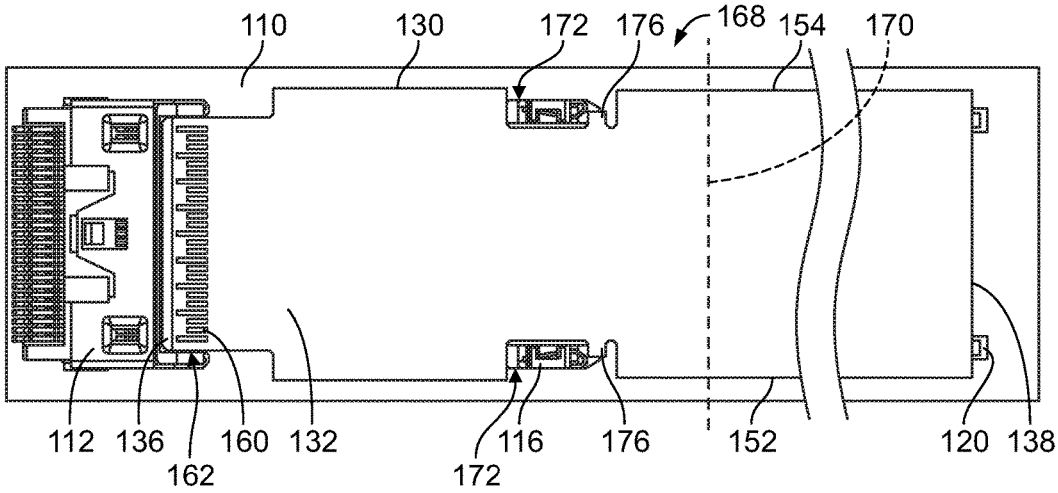
FIG. 5 is a top view of a module circuit board in accordance with an exemplary embodiment.

The intermediate contact pads 164 are provided at an intermediate portion 168 of the module circuit board 130 remote from the front edge 136 and remote from the rear edge 138. For example, the intermediate portion 168, including the intermediate contact pads 164, may be provided near a midline 170 of the module circuit board 130 centered between the front edge 136 and the rear edge 138. For example, the intermediate contact pads 164 may be located closer to the midline 170 then to the front edge 136 or to the rear edge 138. In the illustrated embodiment, the intermediate contact pads 164 are located forward of the midline 170. Optionally, the midline 170 may be located approximately at the location of the rear edge 138 of the short dual connector module 102. The intermediate portion 168 of the module circuit board 130 is configured to be supported by the second electrical connector 116 when mated thereto, such as illustrated in FIG. 5.

The module circuit board 130 includes cutouts 172 at the first and second side edges 152, 154 near the intermediate portion 168. The shell 142 includes pockets 174 above the cutouts 172. The cutouts 172 and the pockets 174 are configured to receive portions of the second electrical connector 116 during mating of the dual connector module 106 to the second electrical connector 116 (FIG. 5). In an exemplary embodiment, the module circuit board 130 includes landing pads 176 extending into the cutouts 172. The landing pads 176 are configured to be engaged by the second electrical connector 116 to mechanically secure the dual connector module 106 to the second electrical connector 116 (FIG. 5 shows the module circuit board 130 in the pre-staged position prior to being mated with the landing pads 176 adjacent the second electrical connector 116).

Figure 6:
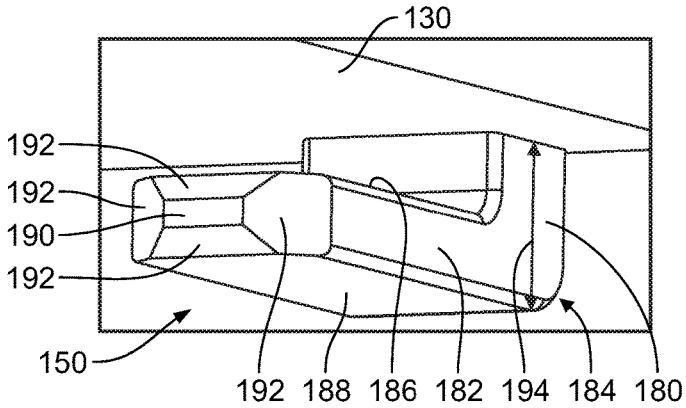
FIG. 6 is a bottom perspective view of a rear support of the dual connector module in accordance with an exemplary embodiment.

The rear support 150 extends below the lower surface 134 of the module circuit board 130 proximate to the rear edge 138. With additional reference to FIG. 6, which is a bottom perspective view of the rear support 150 extending below the module circuit board 130, the rear support 150 is used to support the rear edge 138 of the module circuit board 130. The rear support 150 includes a base 180 and a beam 182 extending forward from the base 180. The base 180 is fixed to the module circuit board 130 and/or the shell 142. The beam 182 extends forward from the base 180 and is spaced apart from the lower surface 134. The base 180 and the beam 182 form a hook 184 configured to be anchored to the support anchor 120 (shown in FIG. 3).

The beam 182 includes an upper surface 186 and a support surface 188 opposite the upper surface 186. The beam 182 extends to a distal end 190 and includes a lead-in 192 at the distal end 190. The beam 182 is configured to be received in the support anchor 120 to secure the rear support 150 to the support anchor 120 and locate the rear edge 138 relative to the host circuit board 110. In an exemplary embodiment, the support surface 188 is generally planar and extends parallel to the lower surface 134. The support surface 188 is located a distance 194 from the lower surface 134. The distance 194 controls the location of the module circuit board 130 relative to the host circuit board 110 when the rear support 150 supports the module circuit board 130 on the support anchor 120.

Figure 7:
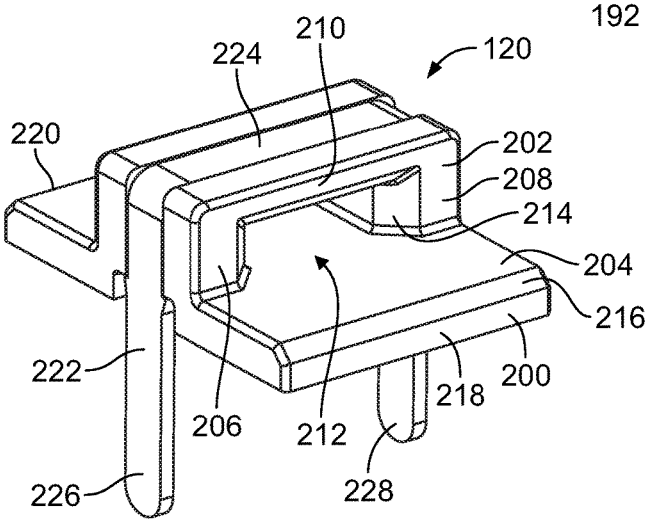
FIG. 7 is a perspective view of a support anchor of the dual connector system in accordance with an exemplary embodiment.

FIG. 7 is a perspective view of the support anchor 120. The support anchor 120 includes a base 200 and a loop 202 extending from the base 200. The base 200 is configured to be mounted to the host circuit board 110 (shown in FIG. 3). The base 200 includes a locating surface 204 along a top of the base 200. The locating surface 204 is used to locate the rear support 150 relative to the support anchor 120. For example, the locating surface 204 supports the rear support 150 (shown in FIG. 6) when coupled thereto.

The loop 200 includes side walls 206, 208 and a top wall 210 extending between the side walls 206, 208 to define a cavity 212 of the loop 202. The cavity 212 receives the rear support 150 to secure the rear support 150 to the support anchor 120. The cavity 212 is sized and shaped to receive the rear support 150. In an exemplary embodiment, the sidewalls 206, 208 and/or the top wall 210 include chamfered lead-ins 214 to guide the rear support 150 into the cavity 212. In an exemplary embodiment, the base 200 include a chamfered lead-in 216 at a rear edge 218 of the base 200 and/or at a front edge 220 of the base 200. The lead-in 216 guides the rear support 150 to the locating surface 204. The lead-ins 214 guide the rear support 150 into the cavity 212.

In an exemplary embodiment, the support anchor 120 includes a mounting feature 222 for mounting the support anchor 120 to the host circuit board 110. In the illustrated embodiment, the mounting feature 222 includes a strap 224 extending around the loop 202 having legs 226, 228 for securing the support anchor 120 to the host circuit board 110. The legs 226, 228 may be soldered to the host circuit board 110. The legs 226, 228 may be secured by other means in alternative embodiments, such as by folding the legs 226, 228 under the host circuit board 110. Other types of mounting features may be provided in alternative embodiments.

Figure 8:
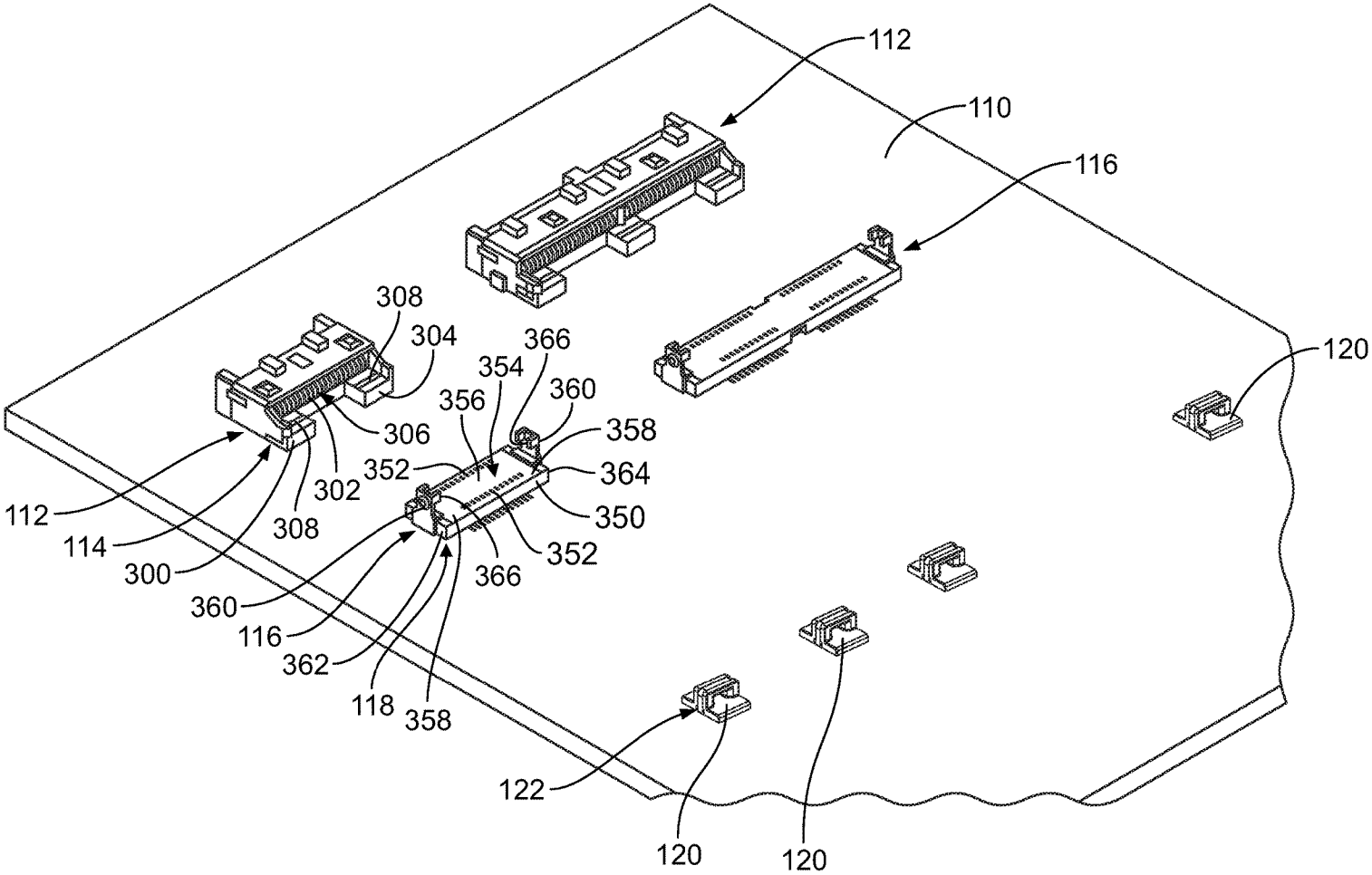
FIG. 8 is a top perspective view of the host circuit board showing electrical connectors and support anchors in accordance with an exemplary embodiment.

FIG. 8 is a top perspective view of the host circuit board 110 in accordance with an exemplary embodiment. The host circuit board 110 includes mounting areas for mounting various dual connector modules 102, 104, 106, 108 (shown in FIG. 1) to the host circuit board 110. In the illustrated embodiment, the host circuit board 110 includes two mounting areas for receiving two dual connector modules. One mounting area is designed for receiving narrow dual connector modules 102 or 106 while the other mounting area is designed for receiving wide dual connector modules 104 or 108.

The mounting areas are subdivided into the front mounting area 114 receiving the first electrical connector 112, the intermediate mounting area 118 receiving the second electrical connector 116 and the rear mounting area 122 receiving the support anchor is 120. In the wide mounting area, the first and second electrical connectors 112, 116 are wider to accommodate the wider dual connector modules 104, 108 and the support anchors 120 are spaced further apart to accommodate the wide dual connector modules 104, 108. In the narrow mounting area, the first and second electrical connectors 112, 116 are narrower to accommodate the narrow dual connector modules 102, 106 and the support anchors 120 are spaced closer together to accommodate the narrow dual connector modules 102, 106.

With additional reference to FIGS. 3-5 for reference to components of the dual pluggable module 106, the first electrical connector 112 includes a housing 300 mounted to the host circuit board 110. The housing 300 holds a plurality of first contacts 302 configured to be terminated to the host circuit board 110. The housing 300 has a mating end 304 configured to be mated with the first connector interface 162 (FIG. 4) of the dual connector module 106. In an exemplary embodiment, the first electrical connector 112 includes a card slot 306 at the mating end 304. The first contacts 302 are arranged in the card slot 306 for mating with the first connector interface 162. For example, the first contacts 302 may be arranged in an upper row and a lower row for interfacing with the front contact pads 160 (FIGS. 4-5) on the upper surface 132 and the lower surface 134 at the front edge 136 of the module circuit board 130.

The housing 300 includes locating surfaces 308 at the mating end 304 for locating the module circuit board 130 relative to the card slot 306 during mating. For example, the locating surfaces 308 may be upward facing surfaces configured to support the front edge 136 of the module circuit board 130 in the pre-staged position. The module circuit board 130 may slide along the locating surfaces 308 during mating as the front edge 136 of the module circuit board 130 is loaded into the card slot 306. The locating surfaces 308 may support the module circuit board 130 in the mated position to prevent damage to the first contacts 302 from the weight of the dual connector module 106.

The second electrical connector 116 includes a housing 350 mounted to the host circuit board 110. The housing 350 holds a plurality of second contacts 352 configured to be terminated to the host circuit board 110. The housing 350 has a mating end 354 configured to be mated with the second connector interface 166 (FIG. 4) of the dual connector module 106. In an exemplary embodiment, the second electrical connector 116 includes an upper mating surface 356 at the mating end 354. The second contacts 352 are arranged along the upper mating surface 356, such as in one or more rows, for mating with the second connector interface 166. The second contacts 352 may include deflectable spring beams configured to be resiliently biased against the second connector interface 166 when the dual connector module 106 is mated to the second electrical connector 116.

The housing 350 includes locating surfaces 358 at the mating end 354 for locating the module circuit board 130 during mating. For example, the locating surfaces 358 may be upward facing surfaces configured to support the intermediate portion 168 of the module circuit board 130. The housing 350 includes towers 360 extending above the locating surfaces 358, such as at opposite sides 362, 364 of the housing 350. The towers 360 include ledges 366 extending over the second electrical connector 116. The ledges 366 are configured to engage the upper surface 132 of the module circuit board 130, such as at the landing pads 176 (FIG. 5), to retain the module circuit board 130 between the ledges 366 and the upper mating surface 356. The ledges 366 prevent lift off of the module circuit board 130 when the dual connector module 106 is in the mated position. The module circuit board 130 is configured to bypass the towers 360 as the dual connector module 106 is loaded to the pre-staged position; however, when the dual connector module 106 is slid forward to the mated position, the module circuit board 130 is slid under the ledges 366 to the mated position.

The module circuit board 130 may slide along the locating surfaces 358 during mating as the front edge 136 of the module circuit board 130 is loaded into the card slot 306. The locating surfaces 358 may support the module circuit board 130, such as at the intermediate portion 168, in the mated position to prevent damage to the second contacts 352 from the weight of the dual connector module 106.

Figure 9:
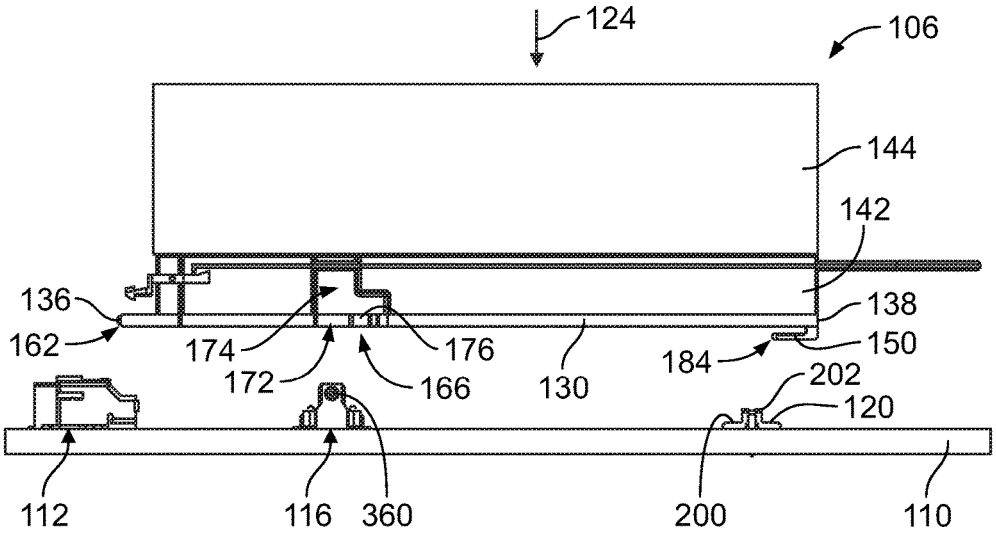
FIG. 9 illustrates the dual connector module poised for coupling to the host circuit board.
Figure 10:
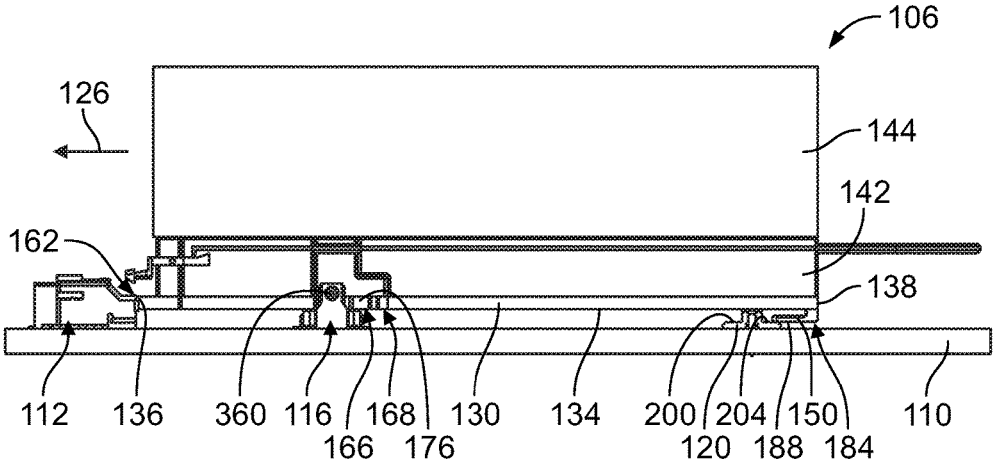
FIG. 10 illustrates the dual connector module in a pre-staged position on the host circuit board.
Figure 11:
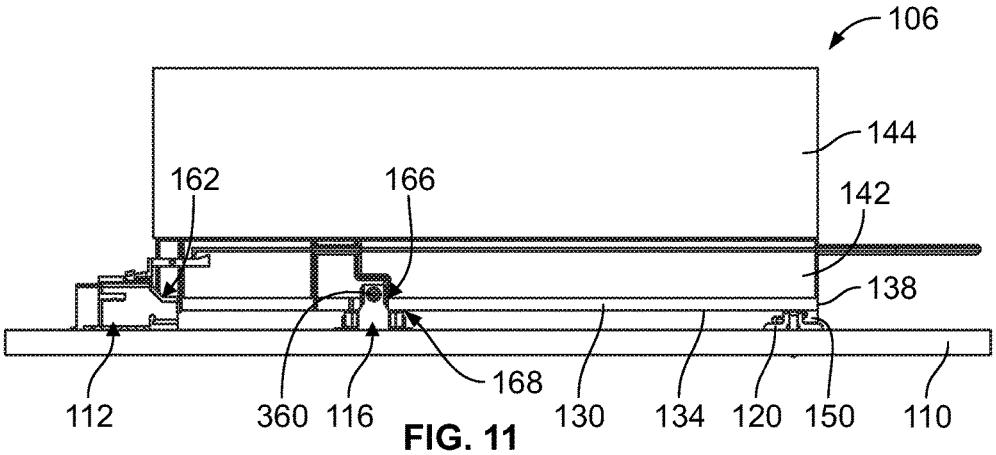
FIG. 11 shows the dual connector module in a mated position on the host circuit board.

FIGS. 9 through 11 show a mating sequence of the dual connector module 106 to the host circuit board 110. FIG. 9 shows the dual connector module 106 poised for coupling to the host circuit board 110 at an elevated positioned above the host circuit board 110. FIG. 10 shows the dual connector module 106 in a pre-staged position. FIG. 11 shows the dual connector module 106 in a mated position.

During mating, the first connector interface 162 is generally aligned with the first electrical connector 112, the second connector interface 166 is generally aligned with the second electrical connector 116 and the rear supports 150 are generally aligned with the support anchors 120. The dual connector module 106 is lowered onto the host circuit board 110 in the loading direction 124. In the pre-staged position (FIG. 10) the towers 360 of the second electrical connector 116 extend through the cutouts 172 in the module circuit board 130 into the pockets 174. The intermediate portion 168 rests on, and is supported by, the locating surfaces 358 (shown in FIG. 8) of the second electrical connector 116. The front edge 136 of the module circuit board 130 rests on, and is supported by, the locating surfaces 308 (shown in FIG. 8) of the first electrical connector 112.

The support surface 188 of the rear support 150 rests on, and is supported by, the locating surface 204 of the base 200 of the support anchor 120 rearward of the loop 202. Optionally, the top wall 210 of the support anchor 120 may support the lower surface 134 of the module circuit board 130. The support surface 188 of the rear support 150 rests on the locating surface 204 to support and locate the rear end of the dual connector module 106 relative to the host circuit board 110. The rear support 150 controls a vertical position of the rear edge 138 of the module circuit board 130 relative to the host circuit board 110. For example, the rear support 150 and the support anchor 120 position the rear edge 138 at a vertical position above the host circuit board 110 such that the module circuit board 130 is parallel to the host circuit board 110. As such, the front edge 136 is positioned at a predetermined vertical position relative to the card slot 306 (shown in FIG. 8) of the first electrical connector 112 to allow the front edge 136 to slide into the card slot 306 as the dual connector module 106 is moved in the mating direction 126 to the mated position (FIG. 11).

As the dual connector module 106 is moved from the pre-staged position (FIG. 10) to the mated position (FIG. 11), the rear support 150 slides along the support anchor 120. For example, the support surface 188 slides along the locating surface 204 to maintain the vertical position of the rear edge 138 as the dual connector module 106 is slid forward. The rear support 150 guides the rear edge 138 during mating of the dual connector module 106 to the host circuit board 110. For example, the support surface 188 is guided along the locating surface 204. The lead-in 214 to the cavity 212 of the loop 202 may help position and guide the rear support 150, and thus the dual connector module 106, as the dual connector module 106 is slid forward. In the mated position (FIG. 11), the hook 184 is received in the cavity 212 of the loop 202. The rear support 150 is anchored to the support anchor 120 to fix a vertical position of the rear edge 138 relative to the host circuit board 110. The loop 202 prevents lift off of the hook 184 by capturing the hook 184 in the cavity 212. The rear edge 138 is unable to be lifted vertically upward when the hook 184 is secured in the loop 202. The rear supports 150 support the weight of the dual connector module 106, such as the weight of the module circuit board 130, the shell 142, the communication components 140 and the heat sink 144. The rear supports 150 prevent vibration and movement of the dual connector module 106, such as to prevent damage to the first electrical connector 112, such as from pivoting of the front edge 136 of the module circuit board 130 about the fulcrum defined by the second electrical connector 116.

As the dual connector module 106 is moved from the pre-staged position (FIG. 10) to the mated position (FIG. 11), the second electrical connector 116 is moved in the cutout 172 and the pocket 174. For example, the module circuit board 130 is slid forward relative to the second electrical connector 116. In the mated position (FIG. 11), the ledges 366 (shown in FIG. 8) of the tower 360 are positioned above the landing pads 176 of the module circuit board 130 to hold the vertical position of the module circuit board 130 within the second electrical connector 116. For example, the module circuit board 130 is captured between the ledges 366 and the upper mating surface 356. The ledges 366 prevent lift off of the module circuit board 130 from the upper mating surface 356.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A dual connector system comprising:

a host circuit board having a first electrical connector at a front mounting area of the host circuit board, a second electrical connector at an intermediate mounting area of the host circuit board, and a support anchor at a rear mounting area of the host circuit board separated and remote from the intermediate mounting area, the support anchor is separate and discrete from the second electrical connector, the intermediate mounting area being positioned between the front mounting area and the rear mounting area generally along a longitudinal axis; and a dual connector module having a module circuit board including an upper surface and a lower surface and extending between a front edge and a rear edge, the lower surface faces the host circuit board, the module circuit board having at least one communication component on the upper surface, the module circuit board having front contact pads proximate to the front edge for electrically connecting to the first electrical connector, the module circuit board having intermediate contact pads remote from the front edge and remote from the rear edge for electrically connecting to the second electrical connector, the dual connector module having a rear support extending below the lower surface of the module circuit board proximate to the rear edge for interfacing with the support anchor, the rear support being located remote from the intermediate contact pads, the rear support used to support the rear edge of the module circuit board relative to the host circuit board at a location remote from the second electrical connector.

2. The dual connector system of claim 1, wherein the rear support guides the rear edge of the module circuit board during mating of the dual connector module to the host circuit board.

3. The dual connector system of claim 1, wherein the rear support controls a vertical position of the rear edge relative to the host circuit board.

4. The dual connector system of claim 1, wherein the rear support is configured to be anchored to the support anchor to fix a vertical position of the rear edge relative to the host circuit board.

5. The dual connector system of claim 1, wherein the front edge of the module circuit board is supported by the first electrical connector above the host circuit board, an intermediate portion of the module circuit board being supported by the second electrical connector above the host circuit board and the rear edge of the module circuit board being supported by the support anchor and the rear support above the host circuit board.

6. The dual connector system of claim 1, wherein the support anchor includes a locating surface, the rear support engages the locating surface and slides along the locating surface as the dual connector module is mated to the first and second electrical connectors.

7. The dual connector system of claim 1, wherein the intermediate contact pads are located closer to a midline of the module circuit board centered between the front edge and the rear edge than to the front edge or to the rear edge.

8. The dual connector system of claim 1, wherein the intermediate contact pads are located forward of a midline of the module circuit board centered between the front edge and the rear edge.

9. The dual connector system of claim 1, wherein the support anchor includes a base and a loop, the rear support being received in the loop to secure the rear support to the support anchor and prevent lift off of the rear support from the support anchor.

10. The dual connector system of claim 1, wherein the support anchor include a top wall positioned below and supporting the lower surface of the module circuit board.

11. The dual connector system of claim 1, wherein the dual connector module includes a shell enclosing the at least one communication component, the rear support extending from the shell.

12. The dual connector system of claim 1, wherein the dual connector module includes a heat sink above the upper surface of the module circuit board being thermally coupled to the at least one communication component, the rear support positioned below the heat sink to support the weight of the heat sink.

13. A dual connector module comprising:

a module circuit board including an upper surface and a lower surface, the module circuit board extending between a front edge and a rear edge, the module circuit board extending between a first side edge and a second side edge, the module circuit board having front contact pads proximate to the front edge along at least one of the upper surface and the lower surface, the front contact pads defining a first connector interface configured for electrically connecting to a first electrical connector, the module circuit board having intermediate contact pads on the lower surface remote from the front edge and remote from the rear edge, the intermediate contact pads defining a second connector interface configured for electrically connecting to a second electrical connector;

a communication component on the upper surface and being electrically connected to at least one of the first connector interface and the second connector interface;

a rear support extending below the lower surface of the module circuit board proximate to the rear edge, the rear support having a support surface a distance below the lower surface for interfacing with a support anchor on the host circuit board, the rear support being located remote from the intermediate contact pads, the rear support used to support the rear edge of the module circuit board relative to the host circuit board at a location remote from the second electrical connector such that the host circuit board is held parallel to and spaced apart from the host circuit board.

14. The dual connector module of claim 13, wherein the rear support guides the rear edge of the module circuit board during mating of the dual connector module to the host circuit board.

15. The dual connector module of claim 13, wherein the rear support controls a vertical position of the rear edge relative to the host circuit board.

16. The dual connector module of claim 13, wherein the rear support is configured to be anchored to the support anchor to fix a vertical position of the rear edge relative to the host circuit board.

17. The dual connector module of claim 13, wherein the front edge of the module circuit board is configured to be supported by the first electrical connector above the host circuit board, an intermediate portion of the module circuit board is configured to be supported by the second electrical connector above the host circuit board and the rear edge of the module circuit board is configured to be supported by the rear support above the host circuit board.

18. The dual connector module of claim 13, wherein the intermediate contact pads are located closer to a midline of the module circuit board centered between the front edge and the rear edge than to the front edge or to the rear edge.

19. The dual connector module of claim 13, wherein the intermediate contact pads are located forward of a midline of the module circuit board centered between the front edge and the rear edge.

20. A dual connector system comprising:

a host circuit board having a first electrical connector at a front mounting area of the host circuit board, a second electrical connector at an intermediate mounting area of the host circuit board, and a support anchor at a rear mounting area of the host circuit board separated and remote from the intermediate mounting area, the support anchor is separate and discrete from the second electrical connector, the intermediate mounting area being positioned between the front mounting area and the rear mounting area generally along a longitudinal axis, the first electrical connector having a card slot and first contacts, the second electrical connector having an upper mating surface and second contacts at the upper mating surface, the support anchor having a base and a loop extending from a top of the base defining a cavity between the loop and the top of the base; and a dual connector module having a module circuit board including an upper surface and a lower surface and extending between a front edge and a rear edge, the lower surface faces the host circuit board, the module circuit board having at least one communication component on the upper surface, the module circuit board having front contact pads proximate to the front edge defining a first connector interface for electrically connecting to the first electrical connector, the module circuit board having intermediate contact pads on the lower surface remote from the front edge and remote from the rear edge defining a second connector interface for electrically connecting to the second electrical connector, the dual connector module having a rear support extending below the lower surface of the module circuit board proximate to the rear edge for interfacing with the support anchor, the rear support being located remote from the intermediate contact pads, the rear support used to support the rear edge of the module circuit board relative to the host circuit board at a location remote from the second electrical connector, the rear support having a support surface spaced apart a distance from the lower surface of the module circuit board;

wherein the dual connector module is coupled to the host circuit board by lowering the dual connector module in a loading direction generally perpendicular to the host circuit board to a pre-stage position where the first connector interface is adjacent to the first electrical connector, the second connector interface is adjacent to the second electrical connector and the support surface of the rear support resting on the top of the base of the support anchor;

wherein the dual connector module is slid forward from the pre-stage position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads; and wherein the rear support is slid forward along the top of the base of the support anchor and received in the cavity to secure the rear support to the support anchor when the dual connector module is moved from the pre-stage position to the mated position.

* * * * *